US006192214B1

(12) United States Patent
Kim et al.

(10) Patent No.: US 6,192,214 B1
(45) Date of Patent: Feb. 20, 2001

(54) ROLLER CLEANING APPARATUS OF LIQUID ELECTROPHOTOGRAPHIC PRINTER

(75) Inventors: Kyung-hwan Kim; Chang-soo Rhee, both of Kyungki-do (KR)

(73) Assignee: Samsung Electronics Co. Ltd., Kyungki-do (KR)

( * ) Notice: Under 35 U.S.C. 154(b), the term of this patent shall be extended for 0 days.

(21) Appl. No.: 09/410,089

(22) Filed: Oct. 1, 1999

(30) Foreign Application Priority Data

Oct. 1, 1998 (KR) ..... 98-41383

(51) Int. Cl.[7] ..... G03G 21/00

(52) U.S. Cl. ..... 399/348; 15/256.5; 399/99; 399/347; 399/350; 399/357; 430/125

(58) Field of Search ..... 399/347, 348, 399/349, 350, 357, 101, 251, 249, 99; 15/256.5, 256.51, 256.52; 430/125

(56) References Cited

U.S. PATENT DOCUMENTS 4,739,370 * 4/1988 Yoshida et al. ..... 399/347
5,359,398 * 10/1994 Echigo et al. ..... 399/348 X
5,723,251 * 3/1998 Moser ..... 399/249 X
5,965,943 * 10/1999 Mizuta ..... 257/763
5,970,281 * 10/1999 Park ..... 399/101
6,026,271 * 2/2000 Saitoh ..... 399/249 X

FOREIGN PATENT DOCUMENTS 8-248775 9/1996 (JP) .
29-94367 10/1999 (JP) .

* cited by examiner

*Primary Examiner*—Sophia S. Chen
(74) *Attorney, Agent, or Firm*—Sughrue, Mion, Zinn, Macpeak & Seas, PLLC

(57) ABSTRACT

A roller cleaning apparatus of a liquid electrophotographic printer cleans a circumferential surface of a roller where a film is formed due to contact with a photoreceptor medium. The apparatus includes an abrasion member installed to be in contact with the roller for abrading the film using friction. Thus, contamination of the roller can be prevented.

14 Claims, 7 Drawing Sheets

ROLLER CLEANING APPARATUS OF LIQUID ELECTROPHOTOGRAPHIC PRINTER

BACKGROUND OF THE INVENTION

1. Field of the Invention

The present invention relates to a roller cleaning apparatus of a liquid electrophotographic printer, and more particularly, to a roller cleaning apparatus of a liquid electrophotographic printer for removing a developer film formed on a roller rotating in contact with a photoreceptor medium.

2. Description of the Related Art

In general, a liquid electrophotographic printer develops an electrostatic latent image formed on a photoreceptor medium such as a photoreceptor web with developer of a predetermined color and transfers the developed image to a print paper so that a desired image is printed.

The liquid electrophotographic printer, as shown in FIG. 1, includes a developing unit 20 for developing an electrostatic latent image formed on a photoreceptor web 10 with developer which is a mixture of powdered toner having a predetermined color, liquid carrier and other additives in a predetermined ratio, a drying unit 30 having a drying roller 31 for drying the developed photoreceptor web 10 and a heating roller 32, a transfer unit 40 for transferring the image on a surface of the photoreceptor web 10 via a transfer roller 41 and a fixation roller 42 to a print paper S.

The drying roller 31 absorbs the liquid carrier of the developer developed on the surface of the photoreceptor web 10. However, as the drying roller 31 contacts the photoreceptor web 10, not only carrier but also a small amount of toner is actually absorbed. Thus, with increased use of the drying roller 31, a developer contamination film can form on the outer circumferential surface of the drying roller 31.

Also, the transfer unit 40 transfers a toner image on the photoreceptor web 10 to the transfer roller 41 utilizing the difference in surface energy and then prints the image by transferring the toner image on the transfer roller 41 to a print paper S pressed by the fixation roller 42. However, in doing so, part of the toner image on the transfer roller 41 may be fixed on the surface of the transfer roller 41, forming a contaminated film. Also, as the developer is sticky, a paper jam can occur due to the print paper S adhering to the surface of the transfer roller 41 as the print paper S moves through the transfer unit 40.

Therefore, there is a need for a cleaning apparatus for cleaning the outer circumferential surfaces of the drying roller 31 and the transfer roller 41 where a developer contamination film can be easily formed, as they closely contact the photoreceptor web 10 where a toner image is developed.

SUMMARY OF THE INVENTION

To meet the above needs, it is an objective of the present invention to provide a roller cleaning apparatus of a liquid electrophotographic printer having an improved structure to clean the outer circumferential surface of a roller such as a transfer roller or drying roller contacting a photoreceptor medium so that a developer contamination film can be removed.

Accordingly, to achieve the above objective, there is provided a roller cleaning apparatus of a liquid electrophotographic printer for cleaning a circumferential surface of a roller where a film is formed due to contact with a photoreceptor medium. The apparatus comprises an abrasion member installed to be in contact with the roller for abrading the film using friction.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Of the transfer roller and the drying roller rotating in contact with a photoreceptor web, the transfer roller is more vulnerable to contamination by developer. Thus, the first, second and third preferred embodiments according to the present invention described below will concentrate on the transfer roller.

Figure 1:
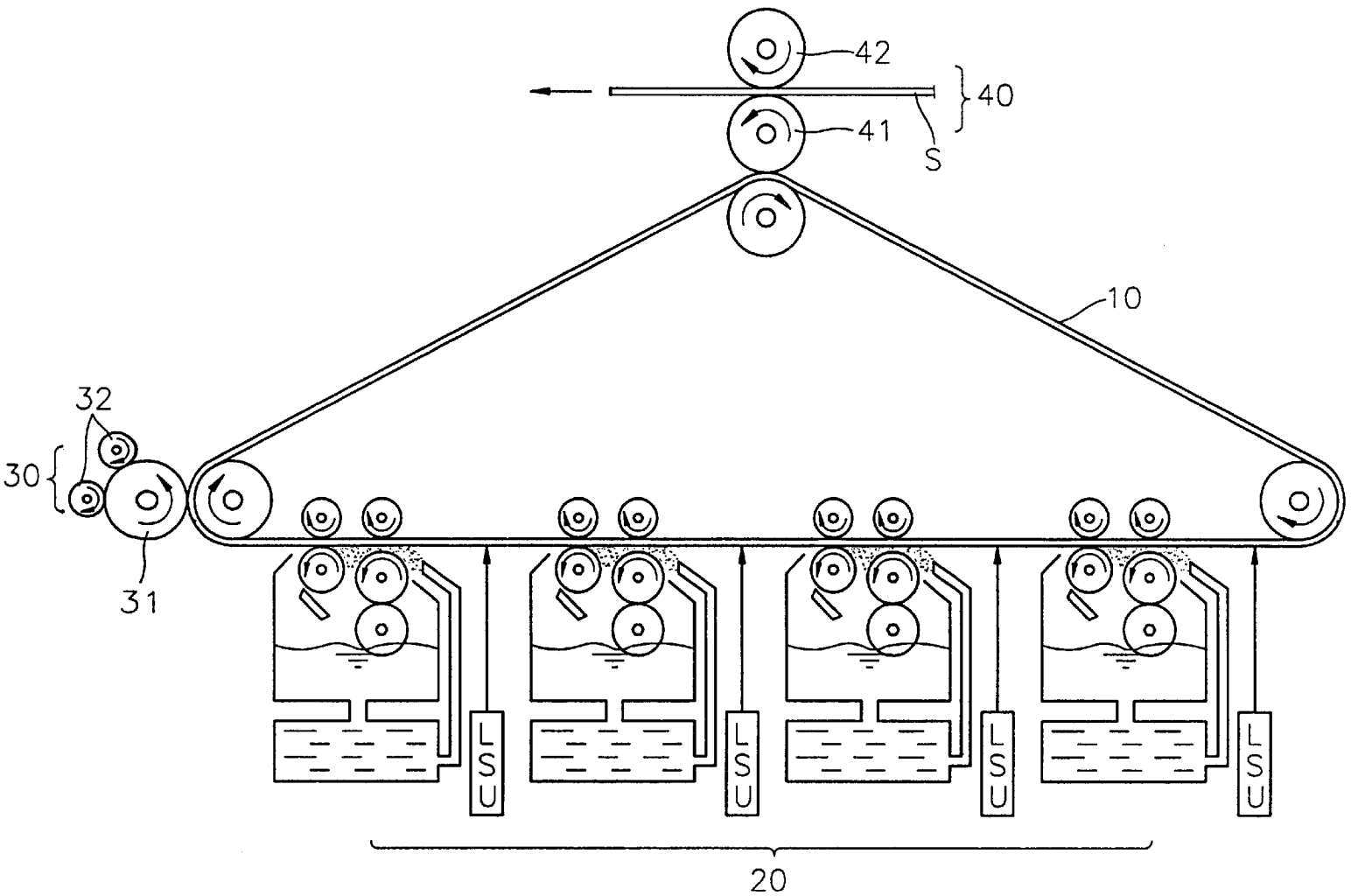
FIG. 1 (PRIOR ART)
FIG. 1 is a view showing the structure of a conventional liquid electrophotographic printer.
Figure 2:
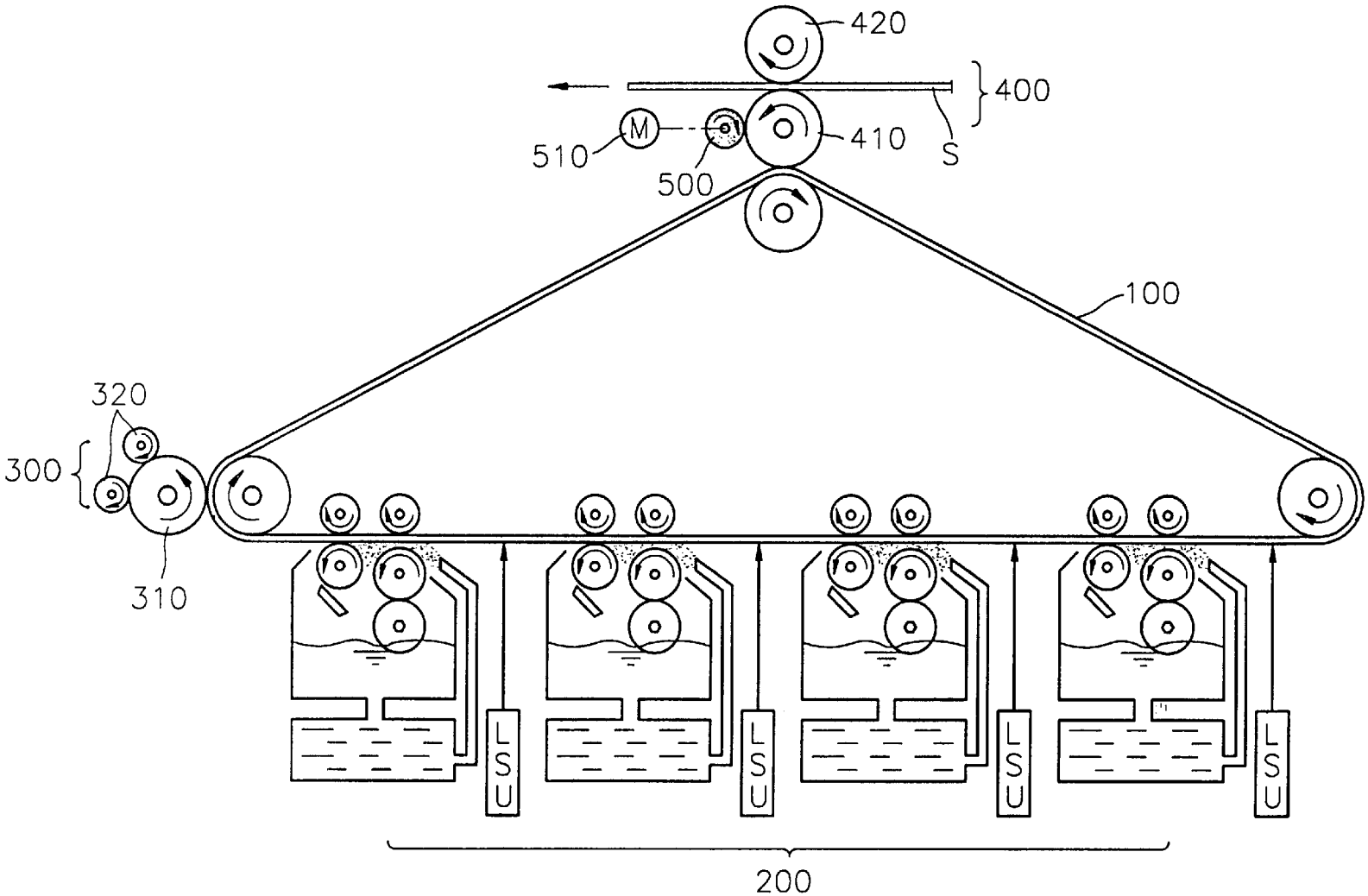
FIG. 2 is a view showing a roller cleaning apparatus according to the first preferred embodiment of the present invention.

FIG. 2 shows a transfer roller cleaning apparatus of a liquid electrophotographic printer according to the first preferred embodiment of the present invention.

Referring to the drawing, a photoreceptor web 100 circulates around a developing unit 200, a drying unit 300 and a transfer unit 400. The developing unit 200 develops an image on the photoreceptor web 100 using a predetermined developer. The drying unit 300 dries the photoreceptor web 100 with a drying roller 310 and a heating roller 320. The transfer unit 400 transfers a toner image transferred onto the transfer roller 410 to a print paper S. Reference numeral 420 denotes a fixation roller. A dressing roller 500, which is rotated by a driving motor 510, is in close contact with the transfer roller 410. The dressing roller 500 is provided with foamed rubber mixed with whetstone powder of 10–40 wt %. Thus, the surface of the dressing roller 500 is formed to be rougher than a general rubber. Preferably, the size of whetstone powder particles is in the range between 220–1000 mesh. This is because, when the particles are too fine, the effect of cleaning is lowered whereas when the particles are too rough the transfer roller 410 may become damaged. Also, the dressing roller 500 rotates at a speed different from that of the transfer roller 410. That is, the speed ratio of the dressing roller 500 and the transfer roller 410 is preferably set in a range from 0.1:1 to 2:1, excluding 1:1. Thus, the dressing roller 500 abrades the surface of the transfer roller 410 with a frictional force caused by the different rotational speeds between the two rollers 410 and 500. Therefore, a contaminated film that forms on the outer circumferential surface of the transfer roller 410 can be removed.

Although the additional driving motor 510 is used to rotate the dressing roller 500 in the above-described embodiment, a driving source (not shown) for driving the photoreceptor web 100 can be used to rotate the dressing roller 500 and the transfer roller 410 at different speeds so as to set the above speed ratio.

Figure 3:
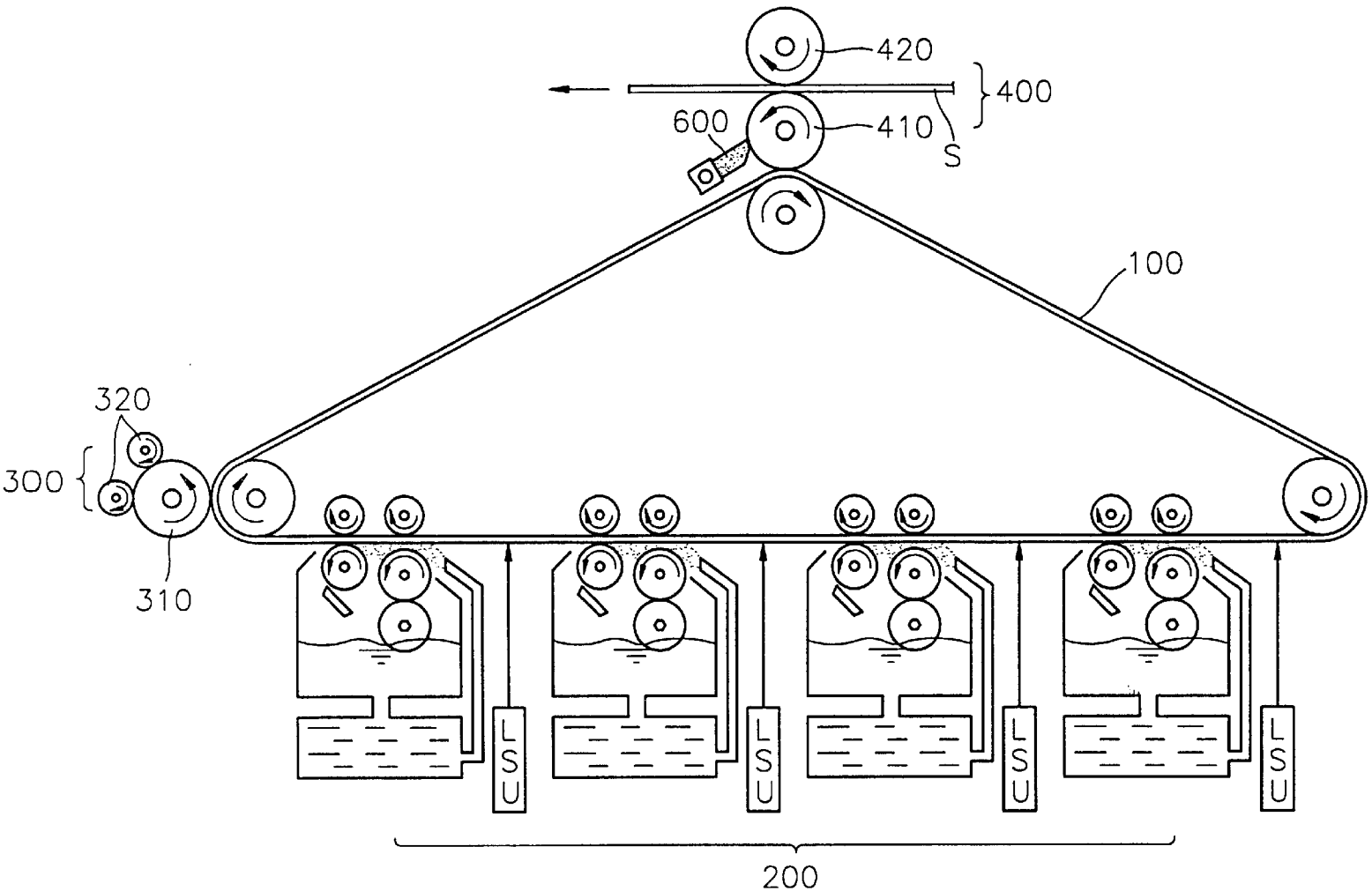
FIG. 3 is a view showing a roller cleaning apparatus according to the second preferred embodiment of the present invention.

FIG. 3 shows a roller cleaning apparatus of a liquid electrophotographic printer according to the second preferred embodiment of the present invention. The structural elements having the same reference numerals as those described with reference to FIG. 2 have the same functions.

In the present embodiment, it is a characteristic feature that an abrasion blade 600 is used to contact the transfer roller 410 instead of the dressing roller 500 of the first preferred embodiment. The abrasion blade 600 is formed of a mixture of foamed rubber and whetstone powder of 10–40 wt %. The whetstone powder having a particle size of 220–1000 mesh is selected. The abrasion blade 600 removes the contaminated film formed on the outer circumferential surface of the transfer roller 410 using a frictional force. Here, the transfer roller 410, together with the fixation roller 420, preferably descends to move into contact with the photoreceptor web 100 and ascends to move out of contact with the photoreceptor web 100. Thus, to make the abrasion blade 600 contact the transfer roller 410 only when the transfer roller 410 closely contacts the photoreceptor web 100, the abrasion blade 600 can be fixed to a frame (not shown) different from a frame (not shown) where the transfer roller 410 is installed. Also, the abrasion blade 600 can be fixed to a frame (not shown) by which the transfer roller 410 is supported so that the abrasion blade 600 can closely contact the transfer roller 410 while ascending or descending together with the transfer roller 410.

Figure 4:
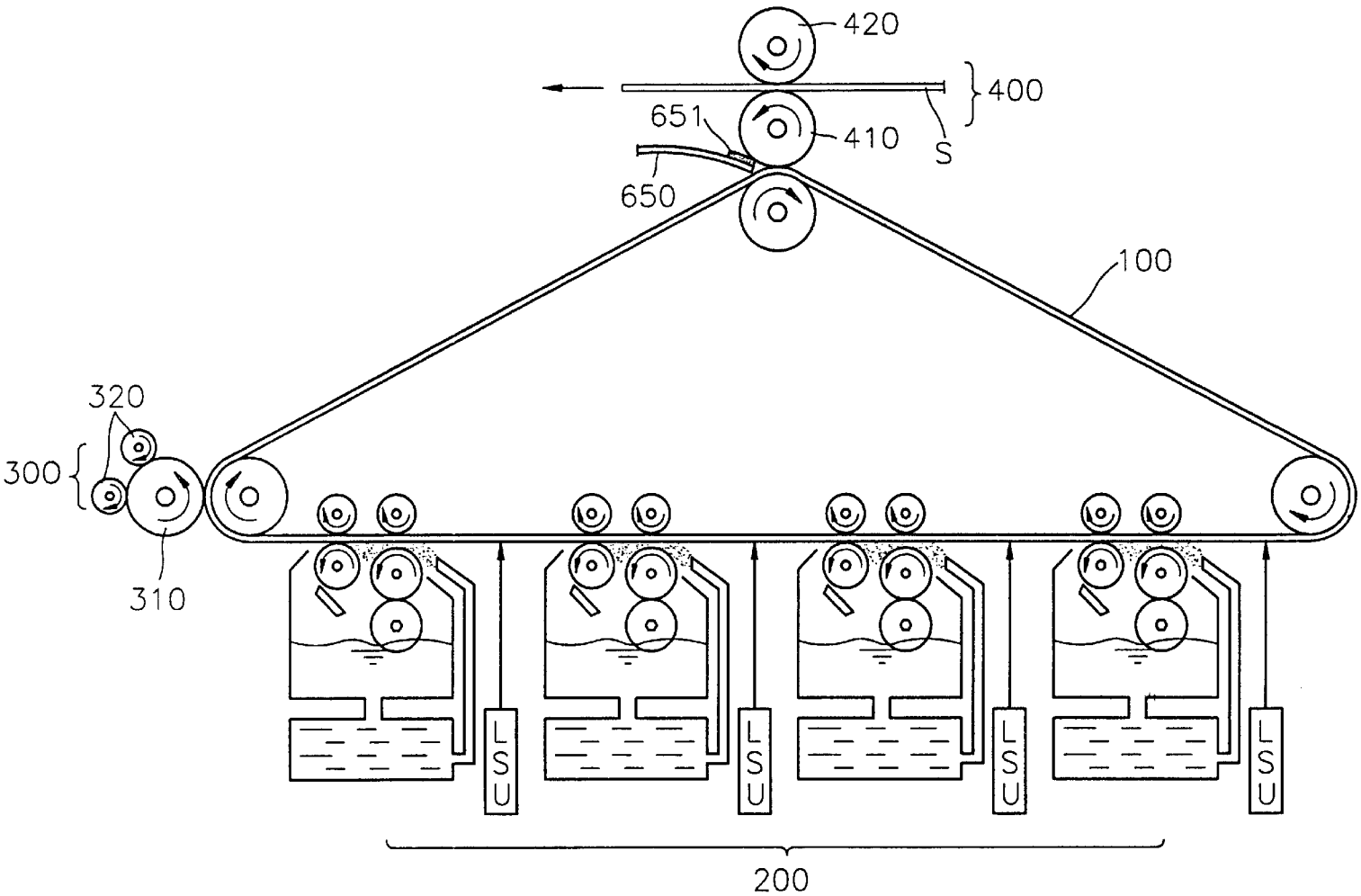
FIG. 4 is a view showing a roller cleaning apparatus according to the third preferred embodiment of the present invention.

FIG. 4 shows the third preferred embodiment of the present invention. In the present preferred embodiment, a sandpaper 651 installed on an elastic piece 650 abrades the outer circumferential surface of the transfer roller 410 while contacting the transfer roller 410, instead of the abrasion blade 600 of the previous preferred embodiment. Here, the size of particles of the sandpaper 651 is preferably between 15 $\mu$m–40 $\mu$m.

Figure 5:
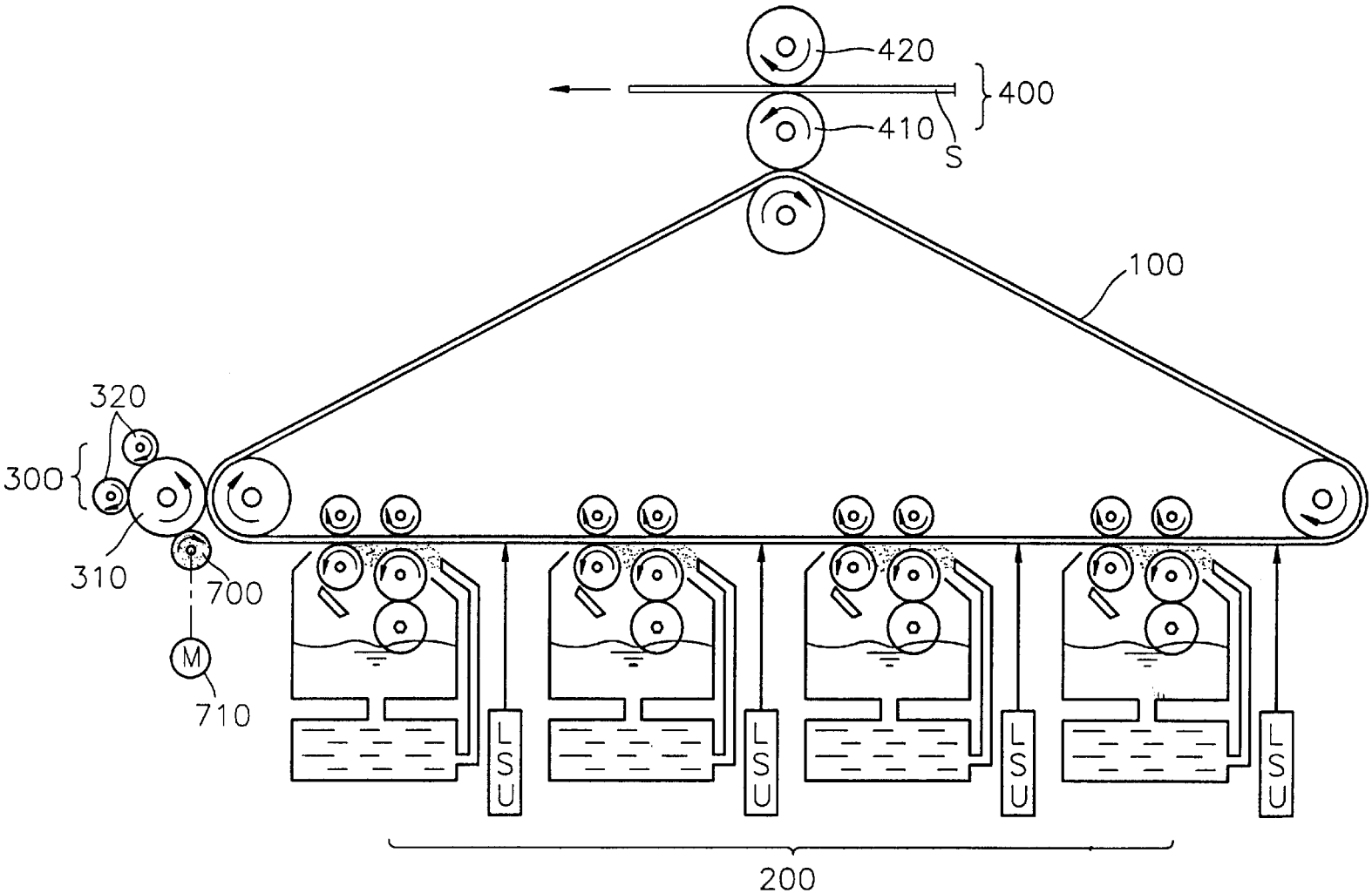
FIG. 5 is a view showing a roller cleaning apparatus according to the fourth preferred embodiment of the present invention.
Figure 6:
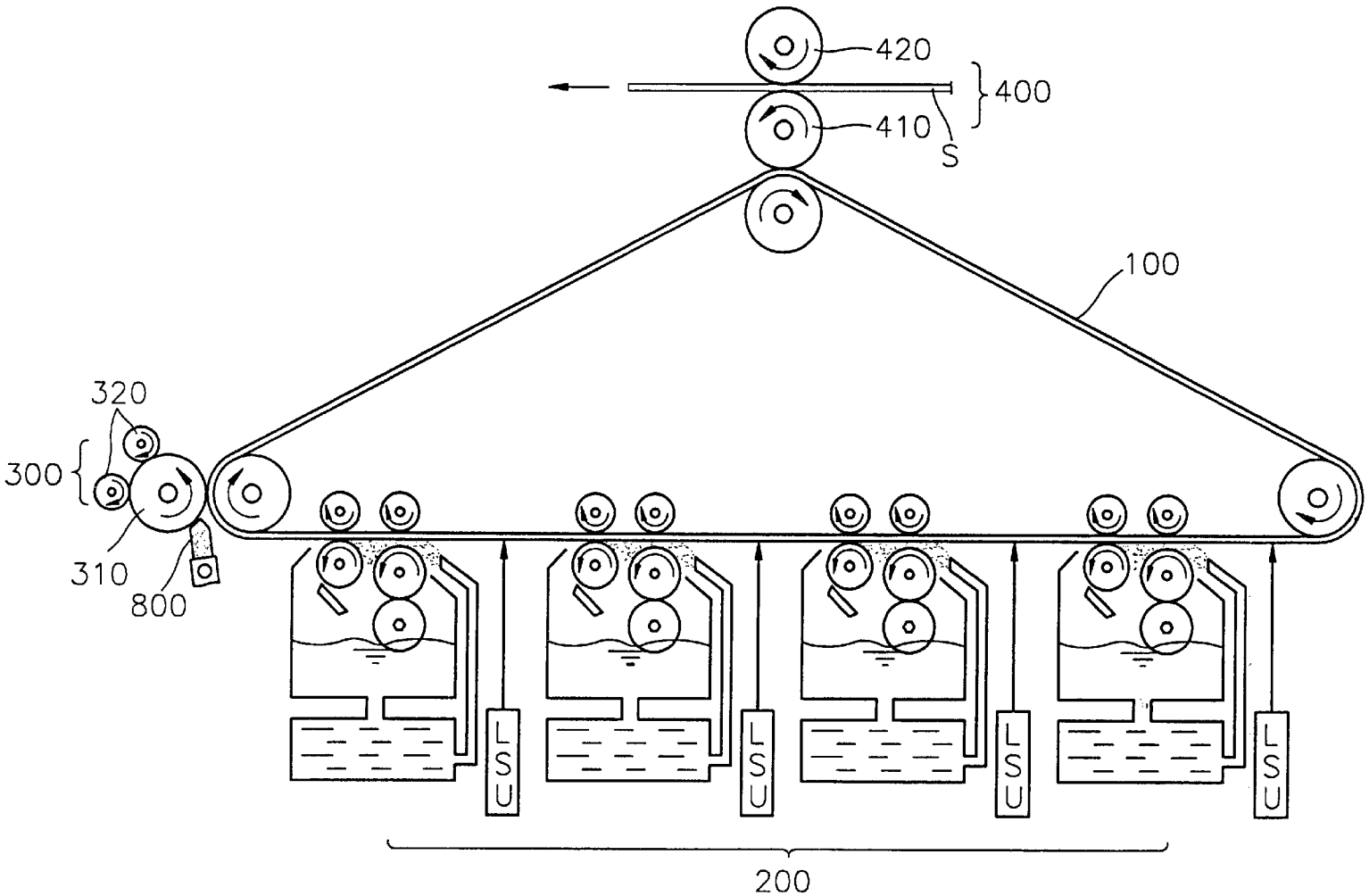
FIG. 6 is a view showing a roller cleaning apparatus according to the fifth preferred embodiment of the present invention.
Figure 7:
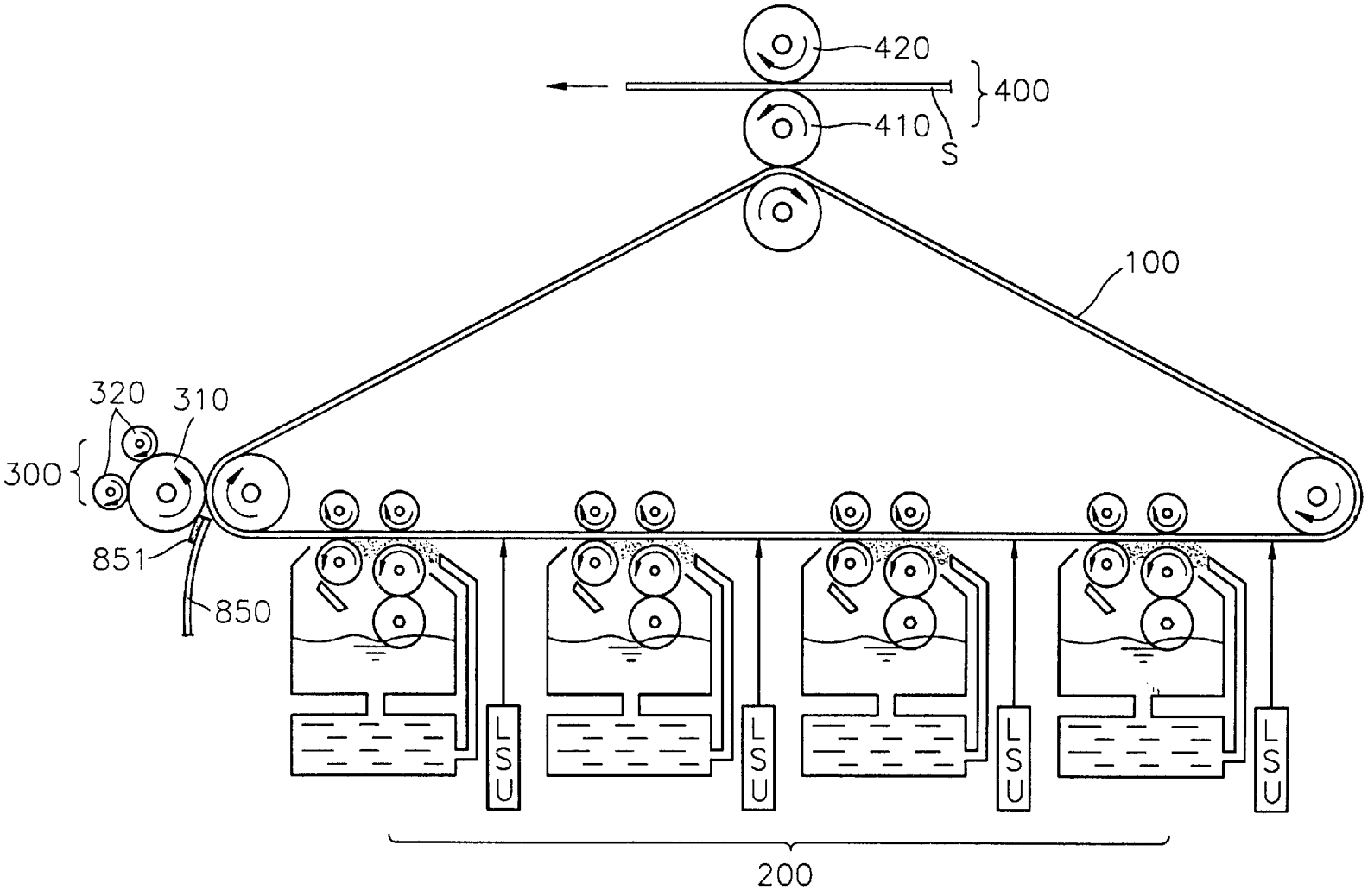
FIG. 7 is a view showing a roller cleaning apparatus according to the sixth preferred embodiment of the present invention.

The cleaning apparatus according to a preferred embodiment of the present invention, as shown in FIGS. 5 through 7, can be adopted to the drying roller 310 of the drying unit 300. The drying roller 310 dries a toner image formed on the photoreceptor web 100 by the developing unit 200, thereby making the toner image suitable for printing. The drying roller 310, while contacting the photoreceptor web 100, absorbs remaining carrier included in the toner image into a surface of the drying roller 310. A dressing roller 700 rotated by a driving motor 710 at a speed different from that of the drying roller 310, as shown in FIG. 5, or an abrasion blade 800 having one end thereof contacting the outer circumferential surface of the drying roller 310, as shown in FIG. 6, is installed to abrade and remove the contaminated film adhering to the surface of the drying roller 310. Here, the dressing roller 700 or the abrasion blade 800 is preferably formed of foamed rubber mixed with whetstone powder having a particle size of 220–1000 mesh at 10–40 wt %. Also, as shown in FIG. 7, a sandpaper 851 attached to an elastic piece 850 can abrade the drying roller 310.

As described above, in the roller cleaning apparatus of a liquid electrophotographic printer according to the present invention, since a developer contamination film formed due to contact with the photoreceptor web is abraded and removed, contamination of the roller can be prevented.

What is claimed is:

1. A roller cleaning apparatus of a liquid electrophotographic printer for cleaning an outer circumferential surface of a roller where a film is formed due to contact with a photoreceptor medium, said apparatus comprising:

an abrasion member installed to be in contact with said roller for abrading said film using friction, wherein said abrasion member comprises a dressing roller, wherein said roller rotates at a first rotational speed, and said dressing roller rotates at a second rotational speed different from said first rotational speed, and wherein said dressing roller abrades said film using friction due to the different rotational speeds;

wherein said dressing roller is formed by mixing foamed rubber with whetstone powder of 10–40 wt %.

2. The roller cleaning apparatus as claimed in claim 1, wherein said whetstone powder has a particle size of 220–1000 mesh.

3. The roller cleaning apparatus as claimed in claim 1, wherein a speed ratio of said second rotational speed to said first rotational speed is preferably set in a range from 0.1:1 to 2:1, excluding 1:1.

4. The roller cleaning apparatus as claimed in claim 1, wherein said abrasion member is an abrasion blade installed to closely contact said outer circumferential surface of said roller.

5. A roller cleaning apparatus of a liquid electrophotographic printer for cleaning an outer circumferential surface of a roller where a film is formed due to contact with a photoreceptor medium, said apparatus comprising:

an abrasion member installed to be in contact with said roller for abrading said film using friction, wherein said abrasion member is an abrasion blade installed to closely contact said outer circumferential surface of said roller, and wherein said abrasion blade is formed by mixing foamed rubber with whetstone powder of 10–40 wt %.

6. The roller cleaning apparatus as claimed in claim 5, wherein said whetstone powder has a particle size of 220–1000 mesh.

7. The roller cleaning apparatus as claimed in claim 5, wherein said roller is a transfer roller for printing an image developed on said photoreceptor medium on a print paper.

8. The roller cleaning apparatus as claimed in claim 5, wherein said roller is a drying roller for drying an image developed on said photoreceptor medium.

9. A roller cleaning apparatus of a liquid electrophotopraphic printer for cleaning an outer circumferential surface of a roller where a film is formed due to contact with a photoreceptor medium, said apparatus comprising:

an abrasion member installed to be in contact with said roller for abrading said film using friction, wherein said abrasion member comprises:

a sandpaper contacting said outer circumferential surface of said roller; and an elastic piece elastically biasing said sandpaper toward said roller.

10. A method for cleaning an outer circumferential surface of a roller of a liquid electrophotographic printer where a film is formed due to contact with a photoreceptor medium, said method comprising:

forming a dressing roller by mixing foamed rubber with whetstone powder of 10–40 wt %, wherein said whetstone powder has a particle size of 220–1000 mesh; and abrading said film using friction caused by an abrasion member installed to be in contact with said roller, wherein said abrading step comprises:

rotating said roller at a first rotational speed;

rotating said dressing roller at a second rotational speed different from said first rotational speed; and abrading said film formed on said outer circumferential surface of said roller via friction, wherein said friction is caused by the different rotational speeds of said dressing roller and said roller in contact with each other.

11. The method as claimed in claim 10, further comprising:

setting a speed ratio of said second rotational speed to said first rotational speed preferably in a range from 0.1:1 to 2:1, excluding 1:1.

12. The method as claimed in claim 10, wherein said abrasion member is an abrasion blade, wherein said abrading step comprises:

abrading said film formed on said outer circumferential surface of said roller via friction, wherein said friction is caused by closely contacting said abrasion blade with said outer circumferential surface of said roller.

13. A method for cleaning an outer circumferential surface of a roller of a liquid electrophotographic printer where a film is formed due to contact with a photoreceptor medium, said method comprising:

forming an abrasion blade by mixing foamed rubber with whetstone powder of 10–40 wt %, wherein said whetstone powder has a particle size of 220–1000 mesh; and abrading said film using friction caused by said abrasion blade installed to be in contact with said roller, wherein said abrading step comprises:

abrading said film formed on said outer circumferential surface of said roller via friction, wherein said friction is caused by closely contacting said abrasion blade with said outer circumferential surface of said roller.

14. A method for cleaning an outer circumferential surface of a roller of a liquid electrophotographic printer where a film is formed due to contact with a photoreceptor medium, said method comprising:

abrading said film using friction caused by an abrasion member installed to be in contact with said roller, wherein said abrasion member comprises a sandpaper attached to an elastic piece, wherein said abrading step comprises:

elastically biasing said sandpaper toward said roller via said elastic piece; and abrading said film formed on said outer circumferential surface of said roller via friction, wherein said friction is caused by contacting said sandpaper with said outer circumferential surface of said roller.

* * * * *